US007858154B2

(12) United States Patent
Schmidt-Thuemmes et al.

(10) Patent No.: US 7,858,154 B2
(45) Date of Patent: Dec. 28, 2010

(54) PAPER COATING SLIP BASED ON PIGMENT-POLYMER HYBRIDS

(75) Inventors: Juergen Schmidt-Thuemmes, Neuhofen (DE); Hubertus Kroener, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 734 days.

(21) Appl. No.: 11/719,219

(22) PCT Filed: Nov. 5, 2005

(86) PCT No.: PCT/EP2005/011851

§ 371 (c)(1),
(2), (4) Date: May 14, 2007

(87) PCT Pub. No.: WO2006/050873

PCT Pub. Date: May 18, 2006

(65) Prior Publication Data

US 2009/0075108 A1 Mar. 19, 2009

(30) Foreign Application Priority Data

Nov. 12, 2004 (DE) ..... 10 2004 054 913

(51) Int. Cl.
*B05D 1/04* (2006.01)
*C09D 4/00* (2006.01)

(52) U.S. Cl. ..... 427/483; 106/285; 162/135; 162/162

(58) Field of Classification Search ..... 427/483; 106/285; 162/135, 162
See application file for complete search history.

(56) References Cited

U.S. PATENT DOCUMENTS

| | | | | |
|---|---|---|---|---|
| 6,080,802 | A * | 6/2000 | Emmons et al. | 523/205 |
| 2003/0068478 | A1 * | 4/2003 | Schadler et al. | 428/195 |
| 2004/0175590 | A1 | 9/2004 | Distler et al. | |

FOREIGN PATENT DOCUMENTS

| | | | |
|---|---|---|---|
| DE | 196 36 490 | | 3/1998 |
| EP | 0 407 059 | | 1/1991 |
| EP | 1 132 521 | | 9/2001 |
| FR | 2873 127 | | 1/2006 |
| WO | 93 12183 | | 6/1993 |
| WO | 01/00712 | * | 1/2001 |
| WO | 01 00712 | | 1/2001 |
| WO | 01 00713 | | 1/2001 |
| WO | 2004 092481 | | 10/2004 |

* cited by examiner

*Primary Examiner*—Frederick J Parker
(74) *Attorney, Agent, or Firm*—Oblon, Spivak, McClelland, Maier & Neustadt, L.L.P.

(57) ABSTRACT

A paper coating slip comprising at least one inorganic pigment and, based on 100 parts by weight of the inorganic pigments, less than 40 parts by weight of organic polymers, and less than 25 parts by weight of water or other solvents having a boiling point below 150° C. at 1 bar.

20 Claims, No Drawings

PAPER COATING SLIP BASED ON PIGMENT-POLYMER HYBRIDS

BACKGROUND OF THE INVENTION

1. Field of the Invention

The invention relates to a paper coating slip comprising at least one inorganic pigment and, based on 100 parts by weight of the inorganic pigments, less than 40 parts by weight of organic polymers and less than 25 parts by weight of water or other solvents having a boiling point below 150° C. at 1 bar.

In particular, the invention also relates to the above paper coating slips in which a binder is bound to the inorganic pigment (referred to below as pigment-polymer hybrid).

2. Description of the Related Art

Paper coating slips usually comprise pigments, organic binders and water.

Water or other solvents are required only for the coating process itself. They permit uniform distribution of pigment and polymer on the paper to be coated.

Anhydrous paper coating slips have the advantage of lower weight. Transport costs can be reduced.

In addition, energy costs are also saved since no drying is required after the coating.

WO 01/00712 and WO 01/00713 disclose anhydrous paper coating slips which comprise organic polymers as pigments (organic pigments for short).

Such organic pigments are expensive and are obtainable only by complicated preparation processes. Anhydrous paper coating slips which need not comprise any organic pigments are therefore desired.

WO 93/12183 discloses a process for the preparation of composite polymer-pigment particles. The polymer adheres to the pigment surface.

Pigment-polymer hybrids and processes for the preparation thereof are disclosed in patent application FR 04 07 806 from Omya (date of application Jul. 13, 2004).

BRIEF DESCRIPTION OF THE INVENTION

It was an object of the present invention to provide paper coating slips having as low a content as possible of water or solvents. The paper coating slips should have good performance characteristics; in particular they should adhere well to paper or cardboard. The coated papers or cardboards should be readily printable. Accordingly, the paper coating slip defined at the outset was found. Paper coating slips which comprise pigment-polymer hybrids were also found.

DETAILED DESCRIPTION OF THE INVENTION

The paper coating slip according to the invention comprises inorganic pigments as a substantial component. These are in particular white pigments. For example, titanium dioxide, aluminum oxide, aluminum hydroxide, kaolin, talc, dolomite, clay, bentonite, calcium carbonate, e.g. in the form of lime, chalk, calcite, marble and/or precipitated calcium carbonate, calcium sulfate and/or barium sulfate, zinc oxide or coating clay may be mentioned.

Titanium dioxide or calcium carbonate is particularly preferred.

In addition to inorganic pigments, organic pigments, as described, for example, in WO 01/00712 and WO 01/00713, may also be concomitantly used. In the context of the present invention, however, such organic pigments are no longer absolutely essential. The proportion of organic pigments is preferably less than 20 parts by weight, in particular less than 10 parts by weight, particularly preferably less than 5 parts by weight, based on 100 parts by weight of inorganic pigment. Particularly preferably, no organic pigments are concomitantly used.

A further substantial component of the paper coating slips is a binder. Suitable binders are natural and synthetic polymers. An example of a suitable natural polymer is starch.

Suitable synthetic polymers are in particular polymers which are obtainable by free radical polymerization of ethylenically unsaturated compounds (monomers).

The binder is preferably a polymer which comprises at least 40% by weight, preferably at least 60% by weight, particularly preferably at least 80% by weight, of so-called main monomers.

The main monomers are selected from $C_1$-$C_{20}$-alkyl (meth)acrylates, vinyl esters of carboxylic acids comprising up to 20 carbon atoms, vinyl aromatics having up to 20 carbon atoms, ethylenically unsaturated nitrites, vinyl halides, vinyl ethers of alcohols comprising 1 to 10 carbon atoms, aliphatic hydrocarbons having 2 to 8 carbon atoms and one or two double bonds or mixtures of these monomers.

For example, alkyl (meth)acrylates having a $C_1$-$C_{10}$-alkyl radical, such as methyl methacrylate, methyl acrylate, n-butyl acrylate, ethyl acrylate and 2-ethylhexyl acrylate, may be mentioned.

In particular, mixtures of the alkyl (meth)acrylates are also suitable.

Vinyl esters of carboxylic acids having 1 to 20 carbon atoms are, for example, vinyl laurate, vinyl stearate, vinyl propionate, vinyl versatate and vinyl acetate.

Suitable vinyl aromatic compounds are vinyltoluene, α- and p-methylstyrene, α-butylstyrene, 4-n-butylstyrene, 4-n-decylstyrene and preferably styrene. Examples of nitriles are acrylonitrile and methacrylonitrile.

The vinyl halides are ethylenically unsaturated compounds substituted by chlorine, fluorine or bromine, preferably vinyl chloride and vinylidene chloride.

For example, vinyl methyl ether or vinyl isobutyl ether may be mentioned as vinyl ethers. Vinyl ethers of alcohols comprising 1 to 4 carbon atoms are preferred.

Ethylene, propylene, butadiene, isoprene and chloroprene may be mentioned as hydrocarbons having 2 to 8 carbon atoms and one or two olefinic double bonds.

Preferred main monomers are $C_1$-$C_{10}$-alkyl (meth)acrylates and mixtures of the alkyl (meth)acrylates with vinyl aromatics, in particular styrene, (polymers comprising these main monomers are referred to together as polyacrylates for short), or, alternatively, hydrocarbons having 2 double bonds, in particular butadiene, or mixtures of such hydrocarbons with vinyl aromatics, in particular styrene, (polymers comprising these main monomers are referred to together as polybutadienes for short).

In the case of mixtures of aliphatic hydrocarbons (in particular butadiene) with vinyl aromatics (in particular styrene), the ratio may be, for example, from 10:90 to 90:10, in particular from 20:80 to 80:20.

In addition to the main monomers, the polymer may comprise monomers having at least one acid group (acid monomer for short), for example monomers having carboxyl, sulfo or phosphonic acid groups. Carboxyl groups are preferred. For example, acrylic acid, methacrylic acid, itaconic acid, maleic acid or fumaric acid may be mentioned.

Further monomers over and above these are, for example, monomers comprising hydroxyl groups, in particular $C_1$-$C_{10}$-hydroxyalkyl (meth)acrylates, and (meth)acrylamide.

In the case of the polybutadienes, particularly preferred polymers are accordingly composed of from 10 to 90% by weight, preferably from 20 to 70% by weight, of aliphatic hydrocarbons having two double bonds, in particular butadiene from 10 to 90% by weight, preferably from 30 to 80% by weight, of vinyl aromatic compounds, in particular styrene from 0 to 20% by weight, preferably from 0 to 10% by weight, of acid monomer from 0 to 20% by weight, preferably from 0 to 10% by weight, of further monomers or, alternatively, in the case of the polyacrylates, of from 10 to 95% by weight, preferably from 30 to 95% by weight, of $C_1$- to $C_{10}$-alkyl (meth)acrylates, from 0 to 60% by weight, preferably from 0 to 50% by weight, of vinyl aromatic compounds, in particular styrene, and from 0 to 20% by weight, preferably from 0 to 10% by weight, of acid monomer from 0 to 20% by weight, preferably from 0 to 10% by weight, of further monomers.

Both the polybutadienes and the polyacrylates preferably comprise acid monomers as comonomers, preferably in an amount of from 1 to 5% by weight. The maximum amount of the above aliphatic hydrocarbons in the case of the polybutadienes or of the alkyl (meth)acrylates in the case of the polyacrylates is correspondingly decreased by the minimum amount of the acid monomers.

In a preferred embodiment, the polymers are prepared by emulsion polymerization, and an emulsion polymer is therefore involved.

The preparation can, however, also be effected, for example, by solution polymerization and subsequent dispersing in water.

In the case of the emulsion polymerization, ionic and/or nonionic emulsifiers and/or protective colloids or stabilizers are used as surface-active compounds.

The surface-active substance is usually used in amounts of from 0.1 to 10% by weight, based on the monomers to be polymerized.

Water-soluble initiators for the emulsion polymerization are, for example, ammonium and alkali metal salts of peroxodisulfuric acid, e.g. sodium peroxodisulfate, hydrogen peroxide or organic peroxides, e.g. tert-butyl hydroperoxide.

So-called reduction-oxidation (redox) initiator systems are also suitable.

The amount of the initiators is in general from 0.1 to 10% by weight, preferably from 0.5 to 5% by weight, based on the monomers to be polymerized. It is also possible to use a plurality of different initiators in the emulsion polymerization.

Regulators can be used in the polymerization, for example in amounts of from 0 to 0.8 part by weight, based on 100 parts by weight of the monomers to be polymerized, the molar mass being reduced by said regulators. For example, compounds having a thiol group, such as tert-butyl mercaptan, the ethylacrylic ester of thioglycolic acid, mercaptoethynol, mercaptopropyltrimethoxysilane or tert-dodecyl mercaptan, are suitable.

The emulsion polymerization is effected, as a rule, at from 30 to 130° C., preferably from 50 to 90° C. The polymerization medium may consist either only of water or of mixtures of water with liquids miscible therewith, such as methanol. Preferably, only water is used. The emulsion polymerization can be carried out both as a batch process and in the form of a feed process, including a step or gradient procedure. The feed process in which a part of the polymerization batch is initially taken, heated to polymerization temperature and partly polymerized and then the remainder of the polymerization batch is fed to the polymerization zone, usually via a plurality of spatially separate feeds, one or more of which comprises the monomers in pure or in emulsified form, continuously, stepwise or with superposition of a concentration gradient, while maintaining the polymerization, is preferred. In the polymerization, a polymer seed may also be initially taken, for example for better adjustment of the particle size.

The manner in which the initiator is added to the polymerization vessel in the course of the free radical aqueous emulsion polymerization is known to the average person skilled in the art. It can either be completely initially taken in the polymerization vessel or used continuously or stepwise at the rate of its consumption in the course of the free radical aqueous emulsion polymerization. Specifically, this depends on the chemical nature of the initiator system and on the polymerization temperature. Preferably, a part is initially taken and the remainder is fed to the polymerization zone at the rate of consumption.

In order to remove the residual monomers, the initiator is usually also added after the end of the actual emulsion polymerization, i.e. after a conversion of at least 95% of the monomers.

In the feed process, the individual components can be added to the reactor from above, at the side or from below through the reactor bottom.

In the emulsion polymerization, aqueous dispersions of the polymer generally having solids contents of from 15 to 75% by weight, preferably from 40 to 75% by weight, are obtained.

Particularly suitable binders are also mixtures of different binders, for example also mixtures of synthetic and natural polymers.

The paper coating slip according to the invention comprises altogether less than 40 parts by weight, preferably less than 20 parts by weight, particularly preferably less than 15 parts by weight, of organic polymers per 100 parts by weight of inorganic pigments.

The content of organic polymers is preferably at least 1 part by weight, particularly preferably at least 3 parts by weight and very particularly preferably at least 5 parts by weight, per 100 parts by weight of inorganic pigments.

The organic polymers are in particular the above binders or mixtures of binders, if appropriate additionally concomitantly used organic pigments (see above) or other polymer additives, for example dispersants or synthetic or natural waxes.

In particular, at least 60% by weight of the total amount of the organic polymers comprise binder; particularly preferably at least 80% by weight, very particularly preferably at least 90% by weight, of the organic polymers comprise binder.

In addition to binder, the paper coating slip can, if appropriate, comprise other nonvolatile compounds (boiling point above 150° C. at 1 bar) or further polymeric compounds as additives. For example release agents, such as silica, talc or inorganic salts, are suitable.

The paper coating slip according to the invention comprises less than 25 parts by weight of water or other solvents having a boiling point below 150° C. (1 bar), based on 100 parts by weight of inorganic pigments. In particular, it comprises less than 20 parts by weight, particularly preferably less than 15 parts by weight, very particularly preferably less than 5 parts by weight or less than 2 parts by weight of water or such solvents per 100 parts by weight of inorganic pigments.

In particular, the paper coating slip according to the invention comprises less than 1 part by weight and, in a particular embodiment, less than 0.2 part by weight of water or such solvents per 100 parts by weight of inorganic pigments. In particular, it comprises no water or other solvents having a boiling point below 150° C. (1 bar).

In the paper coating slip according to the invention, the inorganic pigment is preferably used as a mixture with organic polymers, in particular binders.

For this purpose, the inorganic pigments and organic polymers, in particular the binder, can first be mixed by conventional methods and water or solvent can then be removed down to the above residual content or completely.

The latter can also be effected, for example, by spray drying.

In particular, the inorganic pigment may be milled in the presence of the binder. Water or solvent can be removed before, during or, preferably, after the milling process.

The abovementioned other nonvolatile compounds or assistants can be added to the paper coating slip at any time, for example even before, during or after the removal of water or solvent, or can be added before, during or after the milling process.

Particularly preferably, the inorganic pigment is used in the form of pigment-polymer hybrids. In these hybrids, the organic polymer or binder is chemically or physically bound to the inorganic pigment.

In particular, the binder is adsorbed onto the pigment surface.

The pigment-polymer hybrids comprise an independent particle type having a uniform density. On measurement of the density of the pigment-polymer hybrids using an ultracentrifuge by the static density gradient method (at 21° C. and 1 bar), only one density, i.e. a particle type, is determined. The static density gradient method of measurement is described, for example, in W. Mächtle, M. D. Lechner, Progr. Colloid Polym. Sci (2002) 119, 1.

In order to investigate a sample in the static density gradient (stat. DG), a mixture of light solvent and heavy solvent or additive (as a rule metrizamide/$H_2O$, metrizamide/$D_2O$) is centrifuged at moderate rotor speeds for at least 22 hours. The different sedimentation and diffusion behavior of heavy and light agent leads to the formation of a concentration gradient and hence a density gradient over the cell. Each radial position of the measuring cell therefore has a different solvent density. The sample and the chemically different components of the sample settle out or float within this density gradient exactly at the radial position at which that mixing ratio of light and heavy agent which corresponds to its particle density is present. Highly accurate fractionation of the samples according to the density and hence the chemical composition is therefore possible.

Since the densities of particles differ radically in the investigated system comprising polymer (about 1 g/cm$^3$), calcium carbonate (from 2.6 to 2.95 g/cm$^3$, depending on modification) and polymer/carbonate hybrid, it is possible to detect free polymer or demonstrate the absence of free polymer by measurements of the hybrids in suitable static density gradients.

A pigment-polymer hybrid is obtainable by the above-described mixing and drying or milling of the pigment in the presence of the binder.

The pigment-polymer hybrids have self-binding properties, as described in FR 04 07 806.

The content of the organic polymers and binder in the pigment-polymer hybrids is in particular less than 40 parts by weight, preferably less than 20 parts by weight, particularly preferably less than 15 parts by weight, of organic polymers, per 100 parts by weight of the pigments present in the hybrids.

The content of organic polymers and binder in the pigment-polymer hybrids is preferably at least 1 part by weight, particularly preferably at least 3 parts by weight and very particularly preferably at least 5 parts by weight, per 100 parts by weight of the pigments present in the hybrids.

In the paper coating slips according to the invention, organic polymers, in particular binder, and inorganic pigments are particularly preferably used in the form of the pigment-polymer hybrids. In addition to the pigment-polymer hybrids, organic binders and inorganic pigments, which are not present in the form of the pigment-polymer hybrids, may also be used.

The paper coating slip according to the invention preferably comprises at least 50% by weight, in particular at least 80% by weight, very particularly preferably at least 90% by weight, of pigment-polymer hybrids; in particular the paper coating slip may comprise at least 95% by weight or 98% by weight or 100% by weight of the pigment-polymer hybrids.

Preferably at least 60% by weight, in particular at least 80% by weight and very particularly preferably at least 95% by weight and in particular 100% by weight of the inorganic pigment present altogether in the paper coating slip are present in the form of the pigment-polymer hybrids.

Preferably at least 60% by weight, in particular at least 80% by weight and very particularly preferably at least 95% by weight and in particular 100% by weight of the organic polymers or binders present in the paper coating slip are present in the form of the pigment-polymer hybrids.

The paper coating slip is suitable for the coating of paper or cardboard. The paper coating slip can be applied by suitable methods, in particular dry coating methods, for example by knife-coating or electrostatic charging of the particles to be coated and subsequent coating, in particular spraying on.

The paper coating slip is preferably sprayed on.

After the coating, film formation of the organic polymers or binders at elevated temperatures of preferably from 100 to 250° C. can be effected.

The coated paper or cardboard is obtainable as a whole preferably by a process wherein

- inorganic pigments are milled in the presence of a binder and, if appropriate, of water or solvent and, if appropriate, further assistants,
- if appropriate, drying, preferably spray drying of the mixture obtained for removal of the water or other solvents having a boiling point below 150° C. at 1 bar down to a content of less than 20 parts by weight, preferably less than 5 parts by weight, per 100 parts by weight of inorganic pigment, is effected
- and then, if appropriate, further assistants are added
- and then the paper coating slip is applied to papers or cardboards.

By using the paper coating slips according to the invention, transport and energy costs can be saved.

Besides, the paper coating slips have good performance characteristics, for example good adhesion to the paper and good printability in conventional printing processes.

EXAMPLE

A) Preparation of Pigment-Polymer Hybrids

The preparation was carried out in accordance with the process described in FR 04 07 806 from Omya.

For the preparation of the hybrids H1 and H2, calcium carbonate slurries (Hydrocarb HO-LV from Omya AG) were milled in a DRAIS Polymex mill in the presence of an aqueous dispersion of a carboxylated styrene/acrylate copolymer (Acronal S 728 from BASF AG) as a binder.

The milling conditions were:
Speed of the mill 10 m/s=1280 rpm
Flow rate 2 l/min
Slurry concentration 25% by weight
Duration of milling 60 min For hybrid H1, 10 parts of binder (solid) per 100 parts of $CaCO_3$ were used.

For hybrid H2, 20 parts of binder (solid) per 100 parts of $CaCO_3$ were used.

The polymer-pigment hybrids obtained had the following particle sizes (Malvern Master Sizer):
H1: 82%<1 μm
H2: 81%<1 μm Detection of physical and/or chemical bonding of the polymer to the pigment.

The polymer hybrids H1 and H2 and the polymer used, Acronal S 728, were measured by the method described above, in the static density gradient of the ultracentrifuge. By using four different density gradients, a density range of from 0.95 g/cm$^3$ to 1.30 g/cm$^3$ was thus covered.

In the measurement of the polymer used, a sharp peak is observed at a density of 1.050 g/cm$^3$.

In the measurement of the two polymer hybrids H1 and H2, no peak is observed in the total accessible density range, in particular at the density of the pure polymer.

The polymer/pigment hybrids therefore comprise no unbound polymer.

B) Spray drying

The hybrids were spray-dried as follows in a standard drier, "Minor" model from Niro, equipped with a binary nozzle having a 1.3 mm bore and made of Teflon material.

The starting material chosen was a 25% strength slurry, which was stirred by means of an Ultraturrax at 2000 rpm.
Drier entry temperature 220° C., drier exit temperature 80° C.
Yield 82% (H1)
Yield 79% (H2)

White, free-flowing powders were obtained, for which the following data were measured:
Surface area with nitrogen 5.4 m$^2$/g (H1) 6.2 m$^2$/g (H2)

Powder H1 has a monomodal particle size distribution, determined by Fraunhofer diffraction in air, with a mean particle size of 7 μm.
H2 corresponds to 6 μm C) Coating The powders were applied by means of a knife crater to an untreated 80 g/m$^2$ wood-free base paper from Stora Enso, Oulo Works, and a steel plate at about 155° C. was placed in the coating and pressed on manually for about 10 seconds. A uniformly coated paper having a smooth surface was obtained. The thickness of the coating obtained was 10 μm. The whiteness of the coating was measured using a Datacolor Elrepho 2000 laboratory apparatus and was 90.01 (at R 457). The whiteness (R 457) of customary papers coated with paper coating slips is from 85 to 95.

We claim:

1. A paper coating slip comprising
at least one inorganic pigment in the form of a pigment-polymer hybrid and, based on 100 parts by weight of the inorganic pigments,
from 1 to less than 40 parts by weight of one or more organic polymers chemically or physically bound to the inorganic pigment, and
less than 25 parts by weight of water or other solvents having a boiling point below 150° C. at 1 bar.

2. The paper coating slip according to claim 1, wherein the inorganic pigments are white pigments.

3. The paper coating slip according to claim 1, which comprises no organic pigments.

4. The paper coating slip according to claim 3, which comprises, as a binder, an organic polymer which is composed of at least 40% by weight of one or more monomers selected from the group consisting of $C_1$- to $C_{20}$-alkyl (meth) acrylates, vinyl esters of carboxylic acids comprising up to 20 carbon atoms, vinyl aromatics having up to 20 carbon atoms, ethylenically unsaturated nitriles, vinyl halides, vinyl ethers of alcohols comprising 1 to 10 carbon atoms, and aliphatic hydrocarbons having 2 to 8 carbon atoms and one or more double bonds.

5. The paper coating slip according to claim 3, wherein the polymer is composed of at least 60% by weight of butadiene or mixtures of butadiene and styrene.

6. The paper coating slip according to claim 3, wherein the polymer is composed of at least 60% by weight of $C_1$- to $C_{20}$-alkyl (meth)acrylates or mixtures of $C_1$- to $C_{20}$-alkyl (meth)acrylates with styrene.

7. The paper coating slip according to claim 3, wherein the polymer is an emulsion polymer.

8. The paper coating slip according to claim 1, wherein the content of organic polymers is less than 30 parts by weight per 100 parts by weight of inorganic pigments.

9. The paper coating slip according to claim 1, which comprises less than 5 parts by weight of organic pigments, based on 100 parts by weight of inorganic pigments.

10. The paper coating slip according to claim 2, which comprises no organic pigments.

11. The paper coating slip according to claim 1, which comprises less than 10 parts by weight of water or solvent per 100 parts by weight of inorganic pigment.

12. The paper coating slip according to claim 1, which comprises at least 50% by weight of one or more pigment-polymer hybrids, wherein the organic polymer is chemically bound to the inorganic pigment.

13. The paper coating slip according to claim 1, obtained by first preparing a mixture of the inorganic pigment and the organic polymer for the preparation of a pigment-polymer hybrid and then removing water or solvent to a residual content of less than 20 parts by weight per 100 parts by weight of inorganic pigment.

14. The paper coating slip according to claim 1, wherein, for the preparation of the pigment-polymer hybrid, the inorganic pigment is milled in the presence of the organic polymer.

15. The paper coating slip according to claim 2 wherein the inorganic pigments are titanium oxide or calcium carbonate.

16. The paper coating slip according to claim 1, wherein the inorganic pigment is a calcium carbonate.

17. The paper coating slip according to claim 1, comprising from 5 to less than 40 parts by weight of one or more organic polymers bound to the inorganic pigment.

18. A method for coating paper or cardboard, comprising:
coating a paper with the paper coating slip according to claim 1.

19. The method for a paper coating slip according to claim 15, wherein the paper coating slip is electrostatically charged and then sprayed on the paper.

20. A process for the production of papers or cardboards coated with a paper coating slip, comprising:

milling one or more inorganic pigments in the presence of at least one organic polymer and, optionally water or a solvent to obtain a mixture comprising a pigment-polymer hybrid in which the organic polymer is chemically or physically bound to the inorganic pigment, drying the mixture obtained to remove the water or other solvents having a boiling point below 150° C. at 1 bar to a content of less than 20 parts by weight, per 100 parts by weight of inorganic pigment to form the paper coating slip, and then applying the paper coating slip to papers or cardboards.

* * * * *